United States Patent [19]

Haas

[11] Patent Number: 4,799,332

[45] Date of Patent: Jan. 24, 1989

[54] SLIDING WINDOW

[76] Inventor: Fred Haas, 12 Tollesbury Place, Unionville, Ontario, Canada

[21] Appl. No.: 123,364

[22] Filed: Nov. 20, 1987

[30] Foreign Application Priority Data

Jul. 23, 1987 [CA] Canada ..... 542833

[51] Int. Cl.[4] ..... E06B 7/14

[52] U.S. Cl. ..... 49/408; 49/406; 49/504

[58] Field of Search ..... 49/404, 504, 406, 408, 49/458; 52/207

[56] References Cited

U.S. PATENT DOCUMENTS

| | | | |
|---|---|---|---|
| 2,067,118 | 1/1937 | Case | 49/406 |
| 3,383,801 | 5/1968 | Dallaire | 49/458 |
| 3,859,754 | 1/1975 | Budich et al. | 49/504 X |
| 4,420,907 | 12/1983 | Swan | 49/404 X |
| 4,580,366 | 4/1986 | Hardy | 49/406 |
| 4,674,246 | 6/1987 | Giguere | 52/207 |

FOREIGN PATENT DOCUMENTS

| | | | |
|---|---|---|---|
| 2029972 | 12/1971 | Fed. Rep. of Germany | 49/404 |
| 2729287 | 1/1979 | Fed. Rep. of Germany | 49/504 |
| 2800881 | 7/1979 | Fed. Rep. of Germany | 49/504 |
| 1210410 | 10/1970 | United Kingdom | 49/504 |
| 2116617 | 9/1983 | United Kingdom | 49/408 |
| 2179693 | 3/1987 | United Kingdom | 49/504 |

*Primary Examiner*—Kenneth J. Dorner
*Assistant Examiner*—James R. Brittain

[57] ABSTRACT

A sliding window structure comprises glazing frames received in guide channels of a support frame having side members and top and bottom members. Each of the side members and the bottom member of the support frame comprises inner and outer walls interconnected to provide closed interior tubes with pairs of parallel guide walls on said inner walls forming two parallel guide channels. The top frame member also has a tubular construction with pairs of parallel guide walls forming two parallel guide channels. Each glazing frame member also has inner and outer walls connected by side walls to form a tubular section with the outer walls together defining a rectangular perimeter of the glazing frame for disposition in the guide channels of the support frame. On the inner walls of the glazing frame members, ledge members are provided to form, together with the inner walls, L-shaped glazing recesses. Glazing retaining strips engage engagement means adjacent the glazing recesses thereby to retain glazing in position.

6 Claims, 4 Drawing Sheets

SLIDING WINDOW

The invention relates to a window construction employing extruded thermoplastic window frames, and in particular, to a window construction for sliding windows.

BACKGROUND OF THE INVENTION

The use of extruded thermoplastics for window construction offers numerous advantages. It can be extruded in intricate shapes. Provided suitable thermoplastic material is selected, it can be made strong, and weatherproof, and having an attractive finish not requiring any maintenance. These advantages have been known for many years. Various proposals have been made for employing extruded thermoplastics in windows. A common problem has been a tendency for the material to warp, leading to an unsatisfactory seal around the window. Another problem has been the difficulty of anchoring the window frame to a building structure. Other problems have arisen in that in some cases, the thermoplastic did not offer sufficient support to the window glazing.

Another problem frequently encountered in the past was in the area of security. Thermoplastic extruded windows in many cases did not offer a satisfactory solution to the problem of building security, and in some cases could be opened with relative ease.

Clearly, it is desirable for a thermoplastic window construction to have strength and rigidity and security at least equal to that of conventional metal window designs, without the disadvantages of metal window design particularly in cold climates.

BRIEF SUMMARY OF THE INVENTION

The invention seeks to overcome the various problems noted above by the provision of a sliding window construction of extruded thermoplastic material, and having a support frame with side members and top and bottom members, inner and outer walls on said bottom and side members, intermediate walls connecting said inner and outer walls, forming closed interior tubes in section, pairs of parallel guide walls on said inner walls, said top frame member having a section defining interior tubes, and guide walls forming two parallel channels, glazing frames for receiving glazing, said glazing frames having inner and outer walls, and side walls joining the same and forming a tube in section, and said outer walls defining a rectangular perimeter of a respective said sliding frame adapted to be received in said guide channels on said support frame, and there being on said inner walls of said glazing frames inwardly extending ledge members, and said inner walls and said ledge members defining generally L-shaped glazing recesses and engagement means adjacent said glazing recesses for reception of a glazing retaining strip.

More particularly, it is an objective of the invention to provide a window construction having the foregoing advantages wherein said support frame incorporates exterior facing walls and interior facing walls, and intermediate junction walls extending from said side walls of said tubes, whereby to locate said exterior and interior walls spaced apart from one another.

More particularly, it is an objective of the invention to provide a window construction having the foregoing advantages wherein said support frame includes mounting means on said outer walls of said support frame, said mounting means defining a facing flange, adapted to lie on one face of a building fabric extending at right angles to said outer walls of said support frame.

More particularly it is an objective of the invention to provide a window construction having the foregoing advantages wherein the top member of the support frame incorporates a filler member, and resilient pressure means therefor.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

As discussed above, the invention provides a thermoplastic window construction, in which there are two or more window panels at least one of which is capable of sliding in a track relative to another of the panels.

It is of course well known that in such a sliding window, the sliding function will be satisfactory only so long as the track remains true and free of deformities. It is a characteristic of the present invention that the thermoplastic components are possessed of a high degree of resistance to warping, and are found in practice to provide trouble-free performance under extreme conditions.

Figure 1:
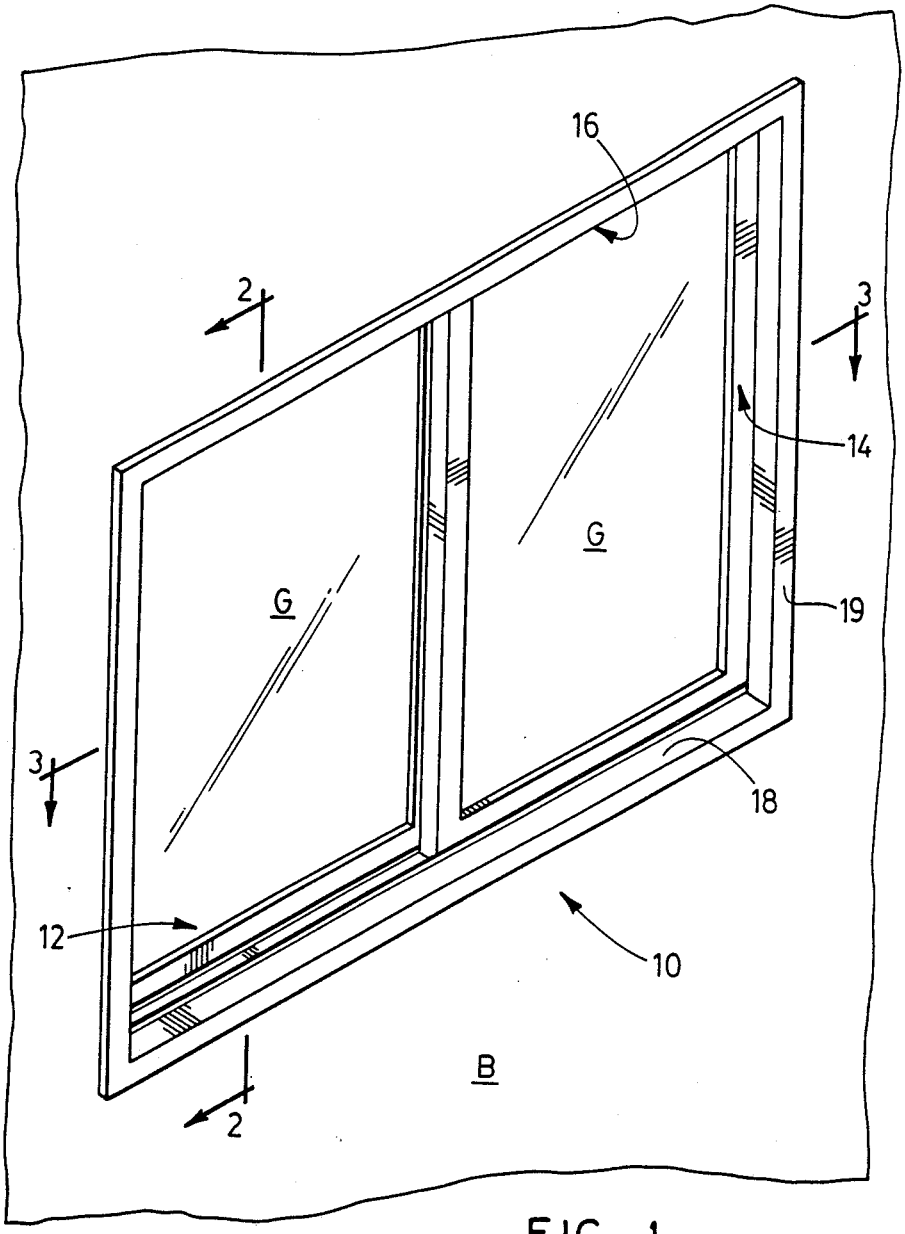
FIG. 1 is a perspective illustration of a window, shown in a wall of a building.

As shown generally in FIG. 1, the window according to the invention comprises a generally rectangular support frame indicated generally as 10, set in a building fabric indicated generally as B.

In the support frame 10, in this embodiment of the invention, there are two glazing frames 12 and 14. Typically, assuming the side of the building B to be the exterior, then the glazing frame 12 would be regarded as the interior window frame, and the frame 14 would be regarded as the exterior. In a typical case, the exterior frame 14 would be fixed in place, and the interior frame 12 would be slidable.

It will of course be appreciated that various other configurations can be arranged, and the configuration shown is merely by way of illustration, and without limitation.

It will also be appreciated that such sliding windows may be associated with other windows which may be fixed, or what are known as "picture" windows.

It will also be appreciated that in some circumstances the window may be made slidable upwardly and downwardly, rather than from side to side.

Glazing indicated generally as G is supported in both of the glazing frames 12 and 14. Depending upon the climate, this may be simply a single pane of glass, or other translucent material, or may be a double or even triple pane of glass to provide thermally efficient windows.

Figure 2:
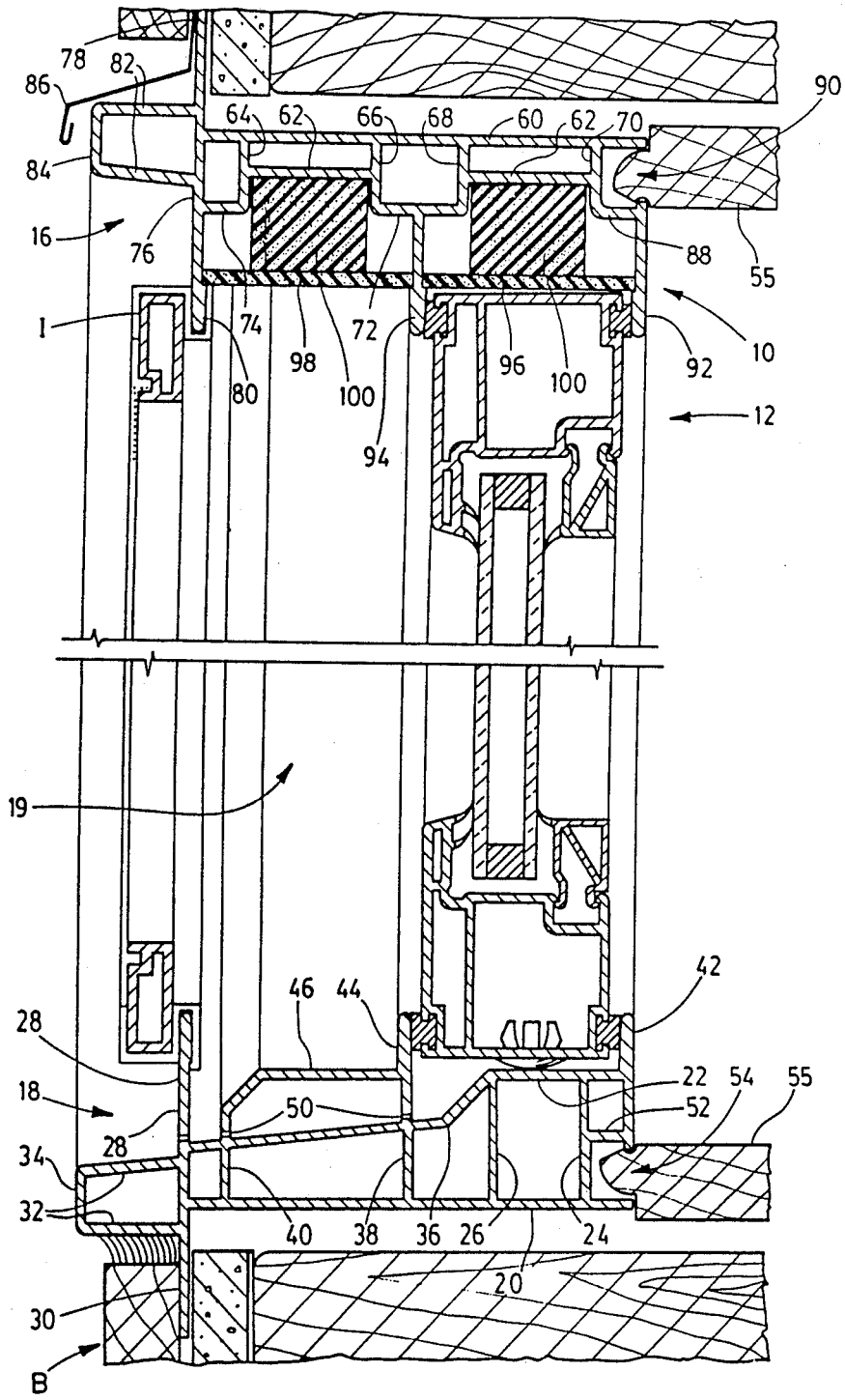
FIG. 2 is a section along the line 2—2 of FIG. 1.
Figure 3:
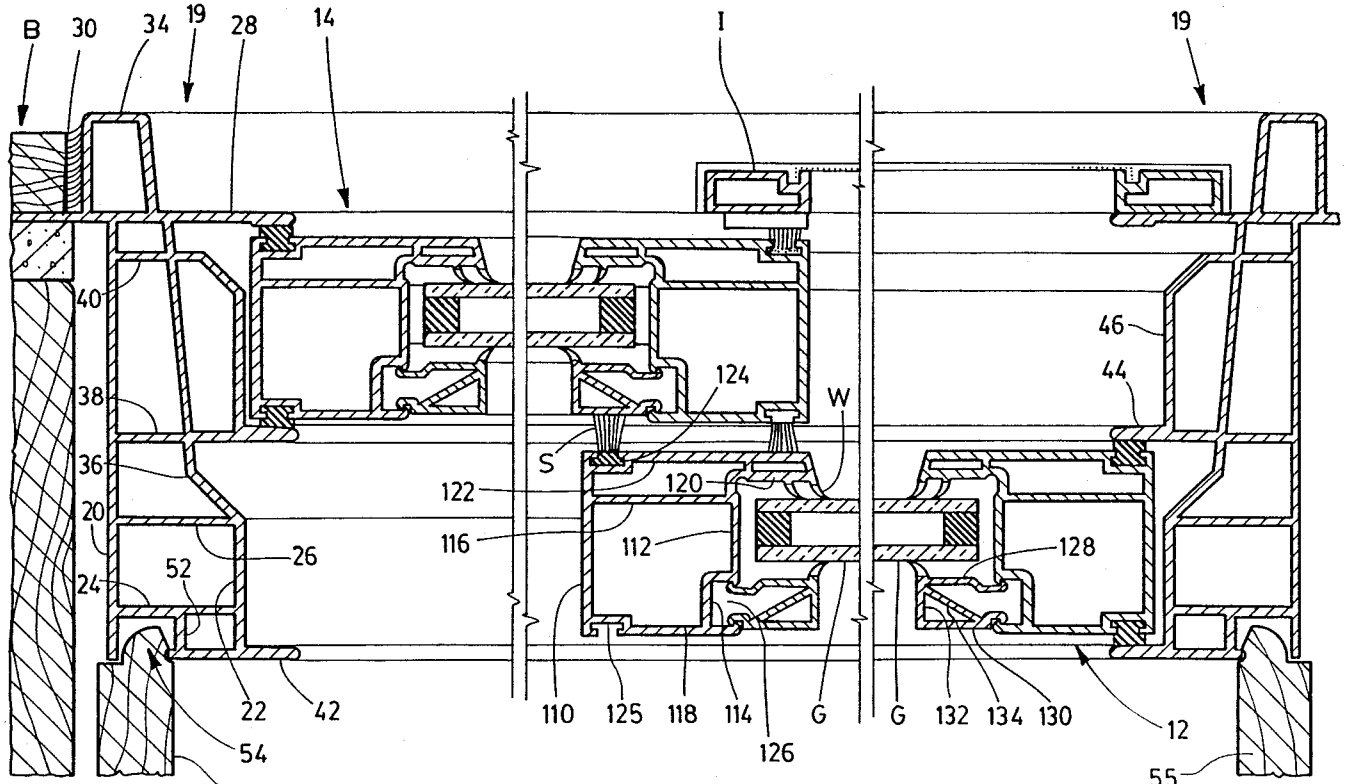
FIG. 3 is a section along the line 3—3 of FIG. 1.
Figure 4:
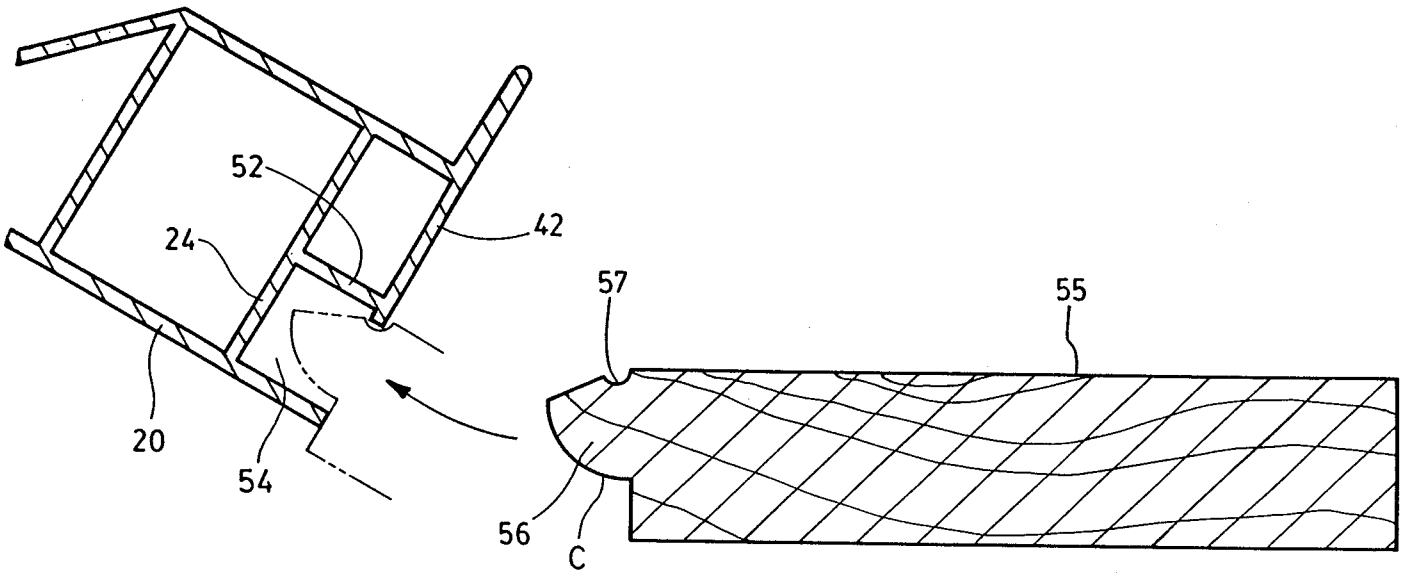
FIG. 4 is an enlarged detail.

Referring now to FIGS. 2 and 3, the support frame 10 will be seen to be made up of four extruded thermoplastic members, namely a top member 16, bottom member 18 and side members 19. The side and bottom members 18 and 19 of the support frame 10 each comprise an outer wall 20, a parallel inner wall 22 spaced from the outer wall, and intermediate walls 24 and 26 joining the outer and inner walls.

These four walls provide an axial tube of rectangular cross section contributing significantly to the overall strength and rigidity of the structure, and assisting in thermal efficiency.

Outer wall 20 forms a continuous planar surface, adapted to abut against or adjacent to the fabric of the building, and extends forwardly to exterior facing wall 28. From the junction between the outer wall 20 and the facing wall 28, a mounting flange 30 extends in the plane of wall 28, adapted to overlie the front face of a building fabric, and to be fastened, typically by nails or screws (not shown).

Exterior trim walls 32—32 and junction wall 34, extend outwardly from wall 28, and form a further tube.

Adjacent the junction between inner wall 22 and intermediate wall 26, a sloping drainage wall 36 extends at a downward and outward angle, being provided with an obtuse angle bend. The drainage wall 36 is joined to the outer wall 20 by means of further intermediate junction walls 38 and 40. At its outer end, drainage wall 36 connects with facing wall 28.

In order to guide the sliding glazing frame 12, a guide track is provided by means of the guide wall 42 extending inwardly from the interior end of inner wall 22, and the further guide wall 44 extends in the plane of intermediate junction wall 38. In order to support the fixed glazing frame 14, a frame support wall 46 is provided, extending from guide wall 44, and the connection of junction wall 40 with drainage wall 36.

The inward portion of facing wall 28 functions as a frame retaining wall for retaining the frame 14 in position.

Drainage holes 50 are typically provided in the walls 44, 46 and 28, adjacent the drainage wall 36, at spaced intervals along the bottom frame member 18. In this way any moisture which becomes trapped either by the wall 44 or the wall 48, may drain down the drainage wall 36, to the exterior of the building.

Guide wall 42 is joined to intermediate wall 24, by means of bracing wall 52. Between the free end of guide wall 42 and the interior free end of the outer wall 20, a channel 54 is provided, to receive the edge of a wooden trim panel 55, for finishing the interior of the window recess.

Panel 55 has a junction rib 56 with a curved cam surface C by means of which it can be inserted into channel 54 at an angle, and rotated. A groove 57 in rib 56 receives the edge of wall 42 and retains panel 55 in position.

As noted above, the structure of the extrusion for the two side frame members 19, is the same as that shown in respect of the bottom frame member 18. However, since any moisture which will collect in these members will drain down to the bottom member 18, the drainage holes 50 are omitted.

The structure of the extrusion for the top frame member 16 is however different from the structure of the extrusions for the members 18 and 19, for reasons which will become apparent.

Thus the extrusion for the top frame member 16 comprises an outer wall 60, and inner walls 62—62, which are flat planar members parallel with one another.

They are joined by four parallel junction walls 64, 66, 68, and 70 forming two parallel channels. Walls 66 and 68 are extended inwardly and joined by spacer wall 72, to form a rectangular tube to provide further strength.

Wall 64 is extended inwardly and connects with tube wall 74 at right angles. Wall 74 is connected to outer wall 60 by facing wall 76.

Facing wall 76 extends outwardly to provide a mounting flange 78. Wall 76 is also extended inwardly to define rib 80. An insect screen I may be supported on rib 80.

Trim walls 82—82 and facing wall 84 extend in the form of a tube forwardly from wall 76. Mounting flange 78 may be fastened to the building fabric typically by means of nails or screws (not shown).

In addition, since this is the top frame member, an angled drip cap strip 86 will be employed, to carry moisture outwardly, and prevent it from collecting on the upper surface of the trim wall 82.

At the free end of junction wall 70, bracing wall 88 extends at right angles. Bracing wall 88, and the free end of outer wall 60, define a channel 90 for reception of an edge of a wooden trim strip 55, for finishing the inside of the window opening.

In order to locate and guide the interior glazing frame 12, guidance wall 92 extends from bracing wall 88. Intermediate guide wall 94 extends from spacer wall 72 in parallel spaced-apart location. In order to locate the exterior glazing frame 14, further guidance is provided by rib 80.

Since this is the top member 16 of the support frame, it is desirable to provide for some form of control, and thermal insulation, between the upper portion of the glazing frames 12 and 14, and the top member 16.

In this embodiment, this is provided by means of the movable filler walls 96 and 98, located respectively between walls 92 and 94, and between wall 94 and rib 80.

In order to provide for resilient pressure on the filler walls 96 and 98, and also to provide some additional degree of thermal insulation, rectangular strips of resilient foam plastic material 100 are bonded to walls 96 and 98. In this way a moderate degree of pressure is continuously applied by the filler walls 96 and 98, to the upper portions of glazing frames 12 and 14.

The four support frame members 16, 18-18 and 19 are cut with mitered corners, and are welded together, to form a solid integral frame.

It will be noted that the support frame 10 has a great inherent strength, having multiple inner and outer walls and junction walls, providing tubes for a high degree of resistance to warping or distortion during use, and, at the same time, providing for a high degree of thermal barrier to the transfer of heat.

Referring once again to FIG. 1, the glazing frames 12 and 14 are both formed of an extrusion of identical construction, and the same extrusion is used on all four frame members of each glazing frame 12 and 14.

Thus, each of the four frame members of each of the glazing frames 12 and 14 comprises an outer wall 110 and an inner wall 112, located in spaced-apart parallel relation. Outer wall 110 is a planar member; and inner wall 112 is shorter than wall 110, and connects with a right angle junction wall 114. A pair of intermediate bracer walls 116 and 118 connect walls 110 and walls 112 and 114 respectively.

Extending from the junction between walls 112 and 116 is a ledge wall 120, designed to support the edge of the glazing G.

An exterior facing wall 122 extends from the edge of outer wall 110, to the inward extent of ledge wall 120.

Sealing channels 124 and 125 are formed adjacent the exterior and interior ends of wall 110, for receiving flexible sealing members S.

The free edges of walls 112, and wall 118, form a channel 126. Within the channel 126 a glazing strip is located, comprised of a pair of parallel walls 128 and 130, and a junction web 132. A diagonal bracing wall 134 extends between them, to provide rigidity.

The free ends of walls 128 and 130 are provided with hooked portions, adapted to be received within channel 126, and to make a snap fit therein. In this way glazing G is retained in position firmly pressed toward ledge 120.

Typically, weather seals W will be provided on the glazing ledge 120, and the wall 128 of the glazing strip, to engage opposite sides of the glazing G.

As will be apparent from FIG. 3, where the two glazing frames 12 and 14 overlap, the two sealing strips S interengage with adjacent surfaces of adjacent glazing frames, and thus provide a two-element weather seal, at this critical juncture between the two glazing frames.

Similarly, where the glazing frames are received in their guide walls of the support frame, they are also provided with two element seals on the exterior, and on the interior, of each of the glazing frames, thus providing a good weather-tight seal all around each glazing frame.

When assembling the glazing frames 12 and 14, the four members of each glazing frame are cut with mitred corners, and are then welded together to provide an integral frame. The glazing G is then placed in position, and the glazing strips are then snapped into their respective channels, thereby holding the glazing in position.

It will thus be seen that, by the provision of hollow extrusions having generally rectangular tubular interior formations, a high degree of rigidity and resistance to warping is provided and, at the same time, a high degree of resistance to thermal conductivity is provided, giving a high quality extruded thermoplastic window construction having a long life, and a high degree of security, and giving a good performance.

It will be understood that suitable means will be provided for fastening the sliding frame to ensure security.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A sliding window construction of extruded thermoplastic material, comprising;

a support frame with side members and top and bottom members;

inner and outer walls on said bottom and side members;

intermediate walls connecting said inner and outer walls of said side and bottom members forming closed tubes in section;

pairs of parallel guide walls on said inner walls of said side and bottom members;

a sloping drainage wall extending from said inner walls of said side and bottom members;

a frame support wall formed on said sloping drainage wall, co-planar with said inner wall of said bottom and side members and having drain opening means in said frame support wall of said bottom member;

said top frame member having a top frame outer wall, and top frame inner walls lying in a common plane and spaced from said top frame outer wall, junction walls extending between said top frame inner and outer walls defining parallel tubular spaces, inward extensions of said junction walls defining spaced parallel channels, top frame guide walls connected to said top frame inner and outer walls, forming two parallel channels;

glazing frames for receiving glazing, said glazing frames having glazing frame inner and outer walls, and side walls joining the same and forming a tube in section, and said outer walls defining a rectangular perimeter of a respective said glazing frame adapted to be received in said guide walls on said support frame, and there being on said glazing frame inner walls, inwardly extending ledge members, and said glazing frame inner walls and said ledge members defining generally L-shaped glazing spaces, and, engagement means adjacent said glazing spaces for reception of a glazing retaining strip.

2. A sliding window construction as claimed in claim 1 wherein said support frame incorporates exterior facing walls and interior facing walls, and junction walls connecting between said facing walls and said inner and outer walls of said top and bottom and side members of said support frames, whereby to locate said exterior and interior walls spaced apart from one another.

3. A sliding window construction as claimed in claim 2 wherein said support frame includes mounting means defining a facing flange, adapted to lie on one face of a building fabric extending at right angles to said outer walls of said support frame.

4. A sliding window construction as claimed in claim 2 including a bracing wall extending between said interior facing walls, and said inner walls of said top and bottom and side members of said support frames, said bracing wall and a said junction wall defining a channel, said interior facing walls extending partially across said channel, and said channel being adapted to receive a trim strip therein.

5. A sliding window construction as claimed in claim 4 including a trim strip, having a junction rib, said junction rib having a curved cam surface, and a retaining groove, adapted to receive an edge of said interior facing wall, whereby to retain said junction rib within said channel.

6. A sliding window construction as claimed in claim 1 wherein said to member of said support frame incorporates a filler member, and resilient pressure means therefor, said pressure means being received in said channels defined by said extension of said junction walls.

* * * * *